US007643643B2

(12) United States Patent
Miyamoto

(10) Patent No.: US 7,643,643 B2
(45) Date of Patent: Jan. 5, 2010

(54) ELECTRONIC APPARATUS

(75) Inventor: Tomofumi Miyamoto, Nishitama-gun (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 841 days.

(21) Appl. No.: 10/814,296

(22) Filed: Apr. 1, 2004

(65) Prior Publication Data

US 2004/0240689 A1 Dec. 2, 2004

(30) Foreign Application Priority Data

May 30, 2003 (JP) ..... 2003-155475

(51) Int. Cl.
*H04R 5/02* (2006.01)
*H04R 1/02* (2006.01)
*H04R 9/06* (2006.01)

(52) U.S. Cl. ..... 381/306; 381/388; 381/349

(58) Field of Classification Search ..... 381/304, 381/306, 303, 300, 333; 361/681; 84/600
See application file for complete search history.

(56) References Cited

U.S. PATENT DOCUMENTS 4,164,988 A * 8/1979 Virva ..... 181/199
5,550,921 A * 8/1996 Freadman ..... 381/300
5,610,992 A 3/1997 Hickman
5,682,290 A 10/1997 Markow et al.
5,805,708 A * 9/1998 Freadman ..... 381/300
5,818,942 A * 10/1998 Freadman ..... 381/300
6,359,994 B1 * 3/2002 Markow et al. ..... 381/333
6,476,304 B2 * 11/2002 Uehara ..... 84/600
6,744,623 B2 * 6/2004 Numano et al. ..... 361/681

FOREIGN PATENT DOCUMENTS

JP 07-222278 8/1995
JP 11-053058 2/1999
JP 2003-015651 1/2003

OTHER PUBLICATIONS

Japanese Office Action dated Feb. 6, 2007 for Appln. No. 2003-155475.

* cited by examiner

*Primary Examiner*—Ping Lee
(74) *Attorney, Agent, or Firm*—Pillsbury Winthrop Shaw Pittman, LLP

(57) ABSTRACT

A speaker unit is arranged in a casing of an electronic apparatus. The speaker unit includes a cabinet, a speaker arranged in the cabinet and exposed to the outside of the cabinet, and a port which is defined in the cabinet to open the outside of the cabinet and through which a sound emitted from the backside of the speaker into the cabinet is radiated outward from the cabinet. The speaker is exposed to the outside of the casing through an opening defined in an outside wall of the casing. The port of the speaker unit opens into the casing.

12 Claims, 8 Drawing Sheets

ELECTRONIC APPARATUS

CROSS-REFERENCE TO RELATED APPLICATIONS

This application is based upon and claims the benefit of priority from prior Japanese Patent Application No. 2003-155475, filed May 30, 2003, the entire contents of which are incorporated herein by reference.

BACKGROUND OF THE INVENTION

1. Field of the Invention

The present invention relates to electronic apparatuses, such as personal computers, and more particularly, to an electronic apparatus having speaker units for sound reproduction therein.

2. Description of the Related Art

Portable electronic apparatuses that are represented by notebook-sized portable computers and mobile communication equipments, such as the one described in U.S. Pat. No. 5,682,290, comprise a casing and a speaker unit for sound reproduction in the casing. Recently, chances of reproducing music or watching images, such as movies, by portable electronic apparatuses have been increasing with the advance of CD drives, DVD drives, etc. Accordingly, there is a demand for the development of high-performance built-in speaker units that ensure high tone quality.

A modern speaker unit disclosed in U.S. Pat. No. 5,610,992 is a so-called bass-reflex speaker unit that has high bass reproducing capability. In general, the bass-reflex speaker unit has an independent speaker box, i.e., a cabinet, a speaker attached to the front face of the cabinet, a port for bass reflex, and a duct or acoustic tube. The port opens in the front face of the cabinet. The acoustic tube communicates with the port and is located in the cabinet. A sound that is radiated from the back of the speaker into the cabinet is partially emitted from the port in phase with a sound that is radiated from the front face of the speaker. Thus, the bass range can be enhanced to reproduce rich low-pitched sounds or voices.

If the speaker unit constructed in this manner is incorporated in a portable computer, for example, the whole cabinet is located in the casing of the computer. The outer surface of the casing is provided with an opening that faces the speaker of the speaker unit and an opening that faces the bass-reflex port. Those parts of the cabinet which are provided individually with the speaker and the port are exposed to the outside through the openings in the casing of the computer, and partially form the outer surface of the casing.

If the bass-reflex speaker unit is thus incorporated in the electronic apparatus, the speaker and the bass-reflex port are exposed outward from the casing of the electronic apparatus. In designing the speaker unit, therefore, the layout of the port and the duct that extends from the port is restricted inevitably. Since those parts of the cabinet which are provided individually with the speaker and the port partially form the outer surface of the casing of the electronic apparatus, moreover, the shape of the cabinet and the like are restricted. Thus, it is hard and takes a lot of time to develop cabinets that fit electronic apparatuses.

Normally, a pair of speaker units are arranged bilaterally. In order to enjoy high bass-range tone quality, the respective cabinets of the two speaker units should preferably have an ideal volume. However, various electronic components are arranged in the casing of a modern electronic apparatus, and the setting space for the speaker units is limited. In some cases, therefore, it is hard to design the bilateral cabinets with the same volume. If the paired cabinets have different volumes, low-pitched sounds that are outputted from the opposite sides are unbalanced and offensive to the ear.

BRIEF SUMMARY OF THE INVENTION

According to an aspect of the invention, an electronic apparatus comprises a casing and a speaker unit located in the casing, the speaker unit including a cabinet, a speaker located exposed in the cabinet, and a port which opens in the cabinet and through which a sound emitted from the backside of the speaker is radiated outward from the cabinet, the speaker being exposed to the outside of the speaker unit through an opening defined in the outside wall of the casing, the port opening into the casing.

Further, an electronic apparatus according to another aspect of the invention comprises a casing and a pair of speaker units, left and right, located in the casing, each of the speaker units including a cabinet, a speaker located exposed in the cabinet, and a port which opens in the cabinet and through which a sound emitted from the backside of the speaker is radiated outward from the cabinet, the speaker being exposed to the outside of the speaker unit through an opening defined in the outside wall of the casing, the port opening into the casing.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A portable computer as an electronic apparatus according to a first embodiment of the present invention will now be described in detail with reference to the accompanying drawings.

Figure 1:
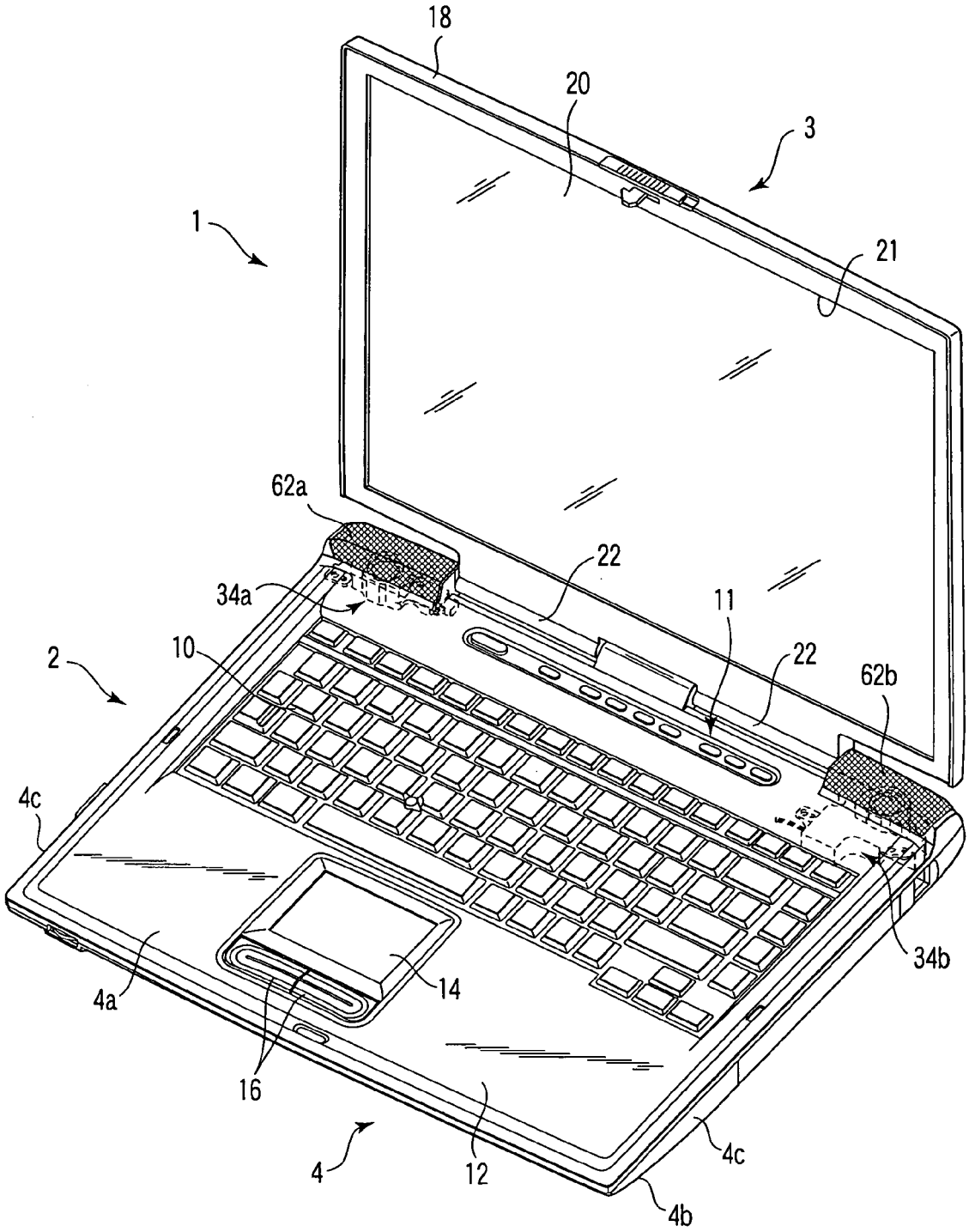
FIG. 1 is a perspective view showing a portable computer according to a first embodiment of the invention.

As shown in FIG. 1, a portable computer 1 comprises a computer body 2 and a display unit 3 that is supported on the body 2. The computer body 2 is provided with a casing 4 that is formed of synthetic resin, for example. The casing 4 is in the form of a flat box, which has a top wall 4*a*, bottom wall 4*b*, left- and right-hand sidewalls 4*c*, front wall 4*d*, and rear wall 4*e*. A keyboard 10 is provided on the central portion of the top wall 4*a*, and various indicators 11 are arranged on the rear end portion of the top wall. The front end portion of the top wall 4*a* forms a palm rest portion 12, and a touch pad 14 and click buttons 16 are arranged substantially in the center of the palm rest portion.

The display unit 3 is provided with a housing 18 in the form of a flat rectangular box and a liquid crystal display panel 20 located in the housing. The panel 20 is exposed to the outside through a display window 21 in the housing 18. The housing 18 has a pair of leg portions 22 that protrude from its one end portion. These leg portions 22 are rockably supported on the rear end portion of the casing 4 by means of hinge portions (not shown). Thus, the display unit 3 is rockable between a closed position in which it is flattened to cover the keyboard 10 from above and an open position in which it stands upright at the back of the keyboard 10.

Figure 2:
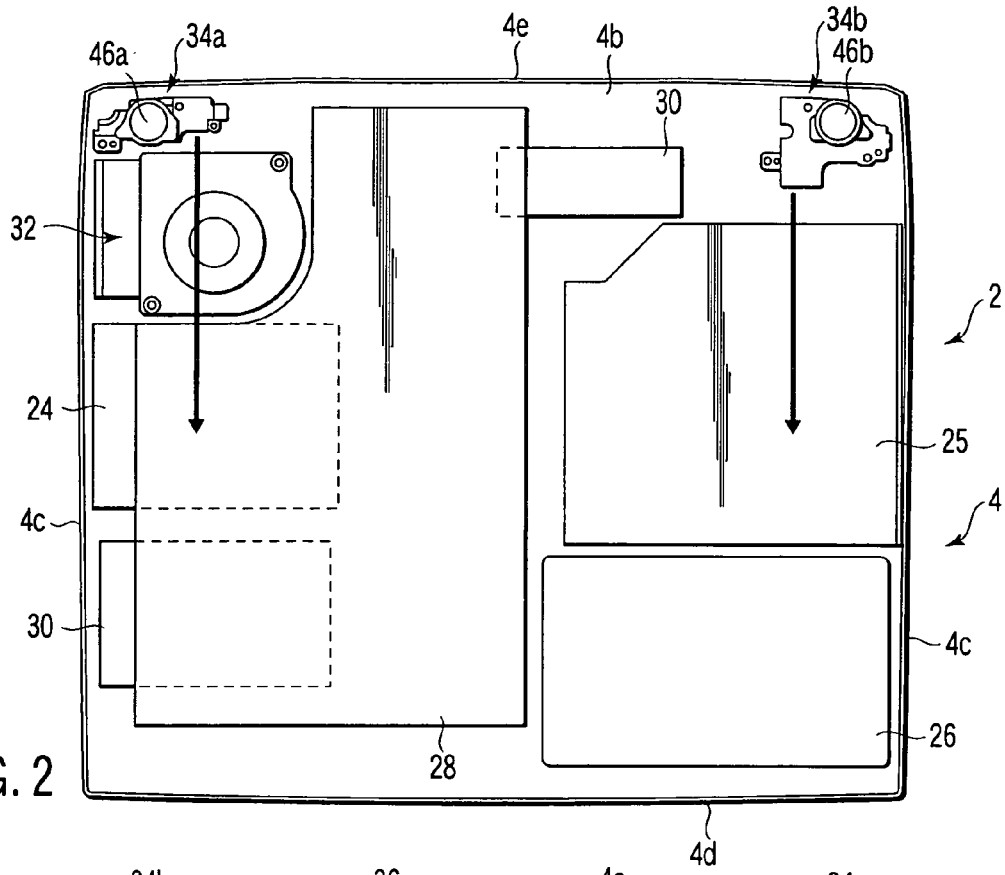
FIG. 2 is a plan view showing the interior of the body of the portable computer.
Figure 3:
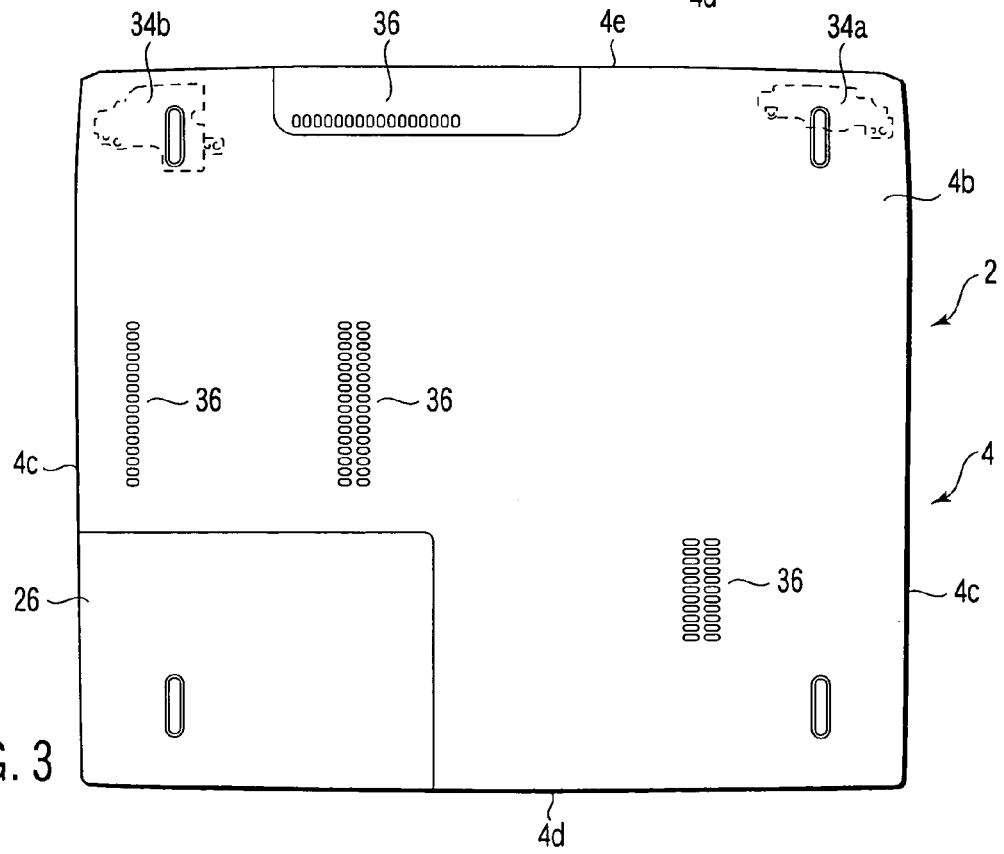
FIG. 3 is a plan view showing the bottom of the computer body.
Figure 4:
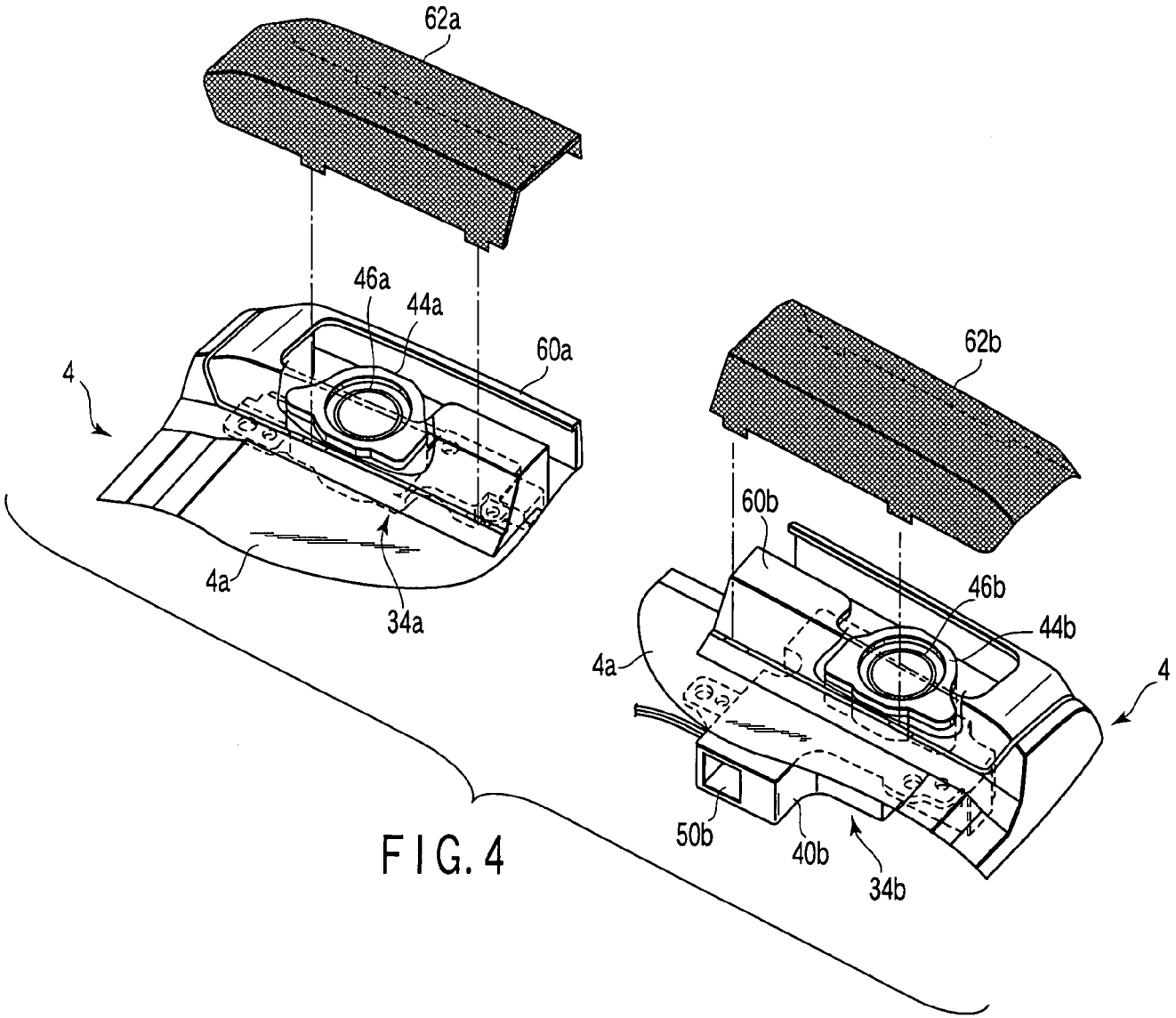
FIG. 4 is an exploded perspective view showing the rear end portion of the body of the portable computer and speaker units.
Figure 5:
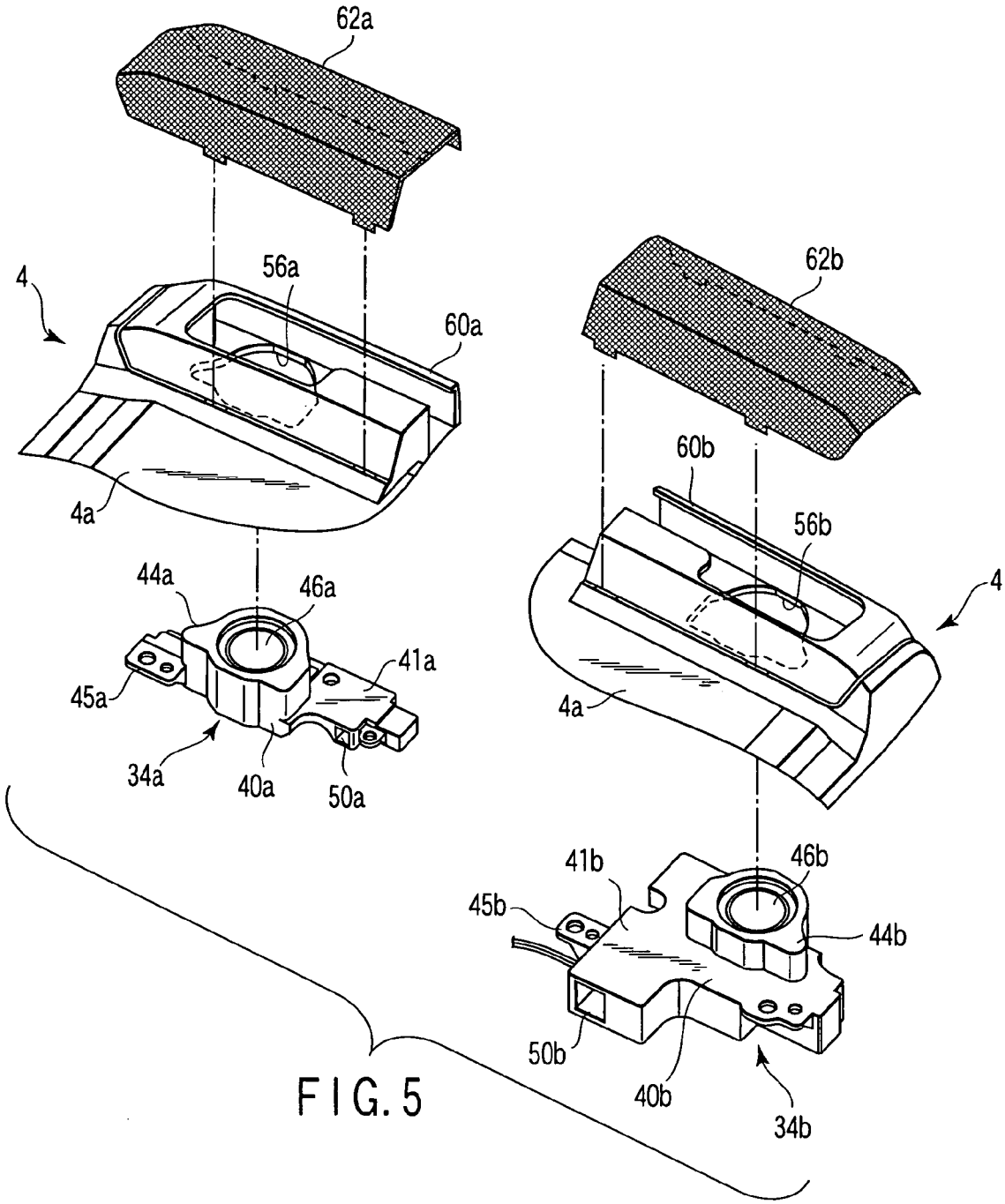
FIG. 5 is an exploded perspective view showing the rear end portion of the computer body and the speaker units.
Figure 6:
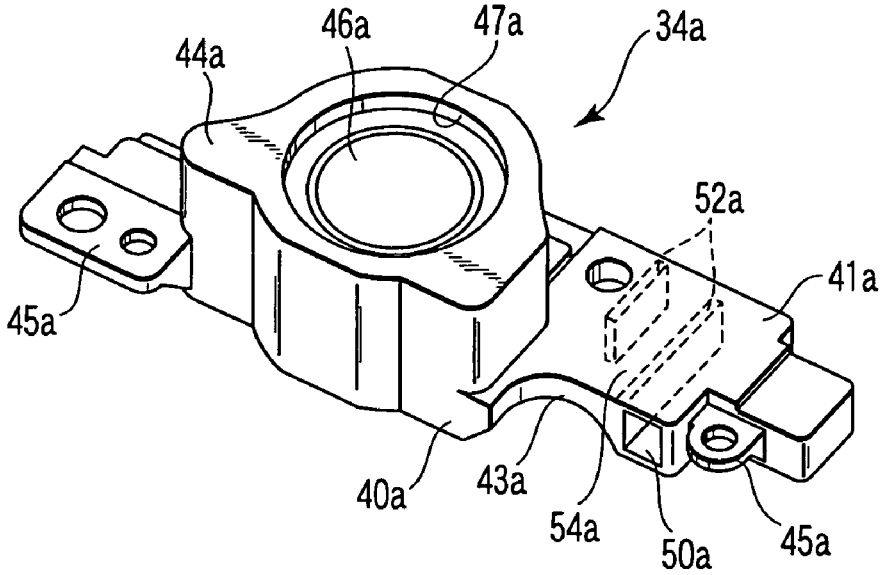
FIG. 6 is a perspective view showing one of the speaker units.

As shown in FIG. 2, the casing 4 of the computer body 2 contains a hard disc drive 24, an optical disc drive 25, such as a CD or DVD, a battery 26, a main printed circuit board 28, sub-printed circuit boards 30, and various other electronic components. Further, a cooling unit 32 having a cooling fan, heat pipe, etc. is located in the casing 4. A pair of speaker units 34*a* and 34*b* are arranged in the rear end portion of the casing 4. They are spaced in the width direction of the casing 4. As shown in FIG. 3, air inlets 36 through which cooling air is sucked into the casing 4 are defined in the bottom wall 4*b* of the casing.

The following is a detailed description of the speaker units 34*a* and 34*b* that are arranged in the casing 4. As shown in FIGS. 4, 5, 6, 8 and 9, the speaker unit 34*a* is provided with a speaker box or hollow cabinet 40*a* formed of synthetic resin, for example, and a speaker 46*a* in the cabinet. The cabinet 40*a* is a substantially flat rectangular structure, which has flat top and bottom faces 41*a* and 42*a* and side faces 43*a*. The cabinet 40*a* has a hollow protrusion 44*a* that protrudes upward from the central part of the top face 41*a*. The speaker 46*a* is situated in the protrusion 44*a* in the cabinet 40*a*. The front face of a diaphragm 48*a* that constitutes the speaker 46*a* is exposed outward from the cabinet 40*a* through an aperture 47*a* in the projected end of the protrusion 44*a*. The cabinet 40*a* is formed integrally with brackets 45*a* that are used to screw down the speaker unit 34*a*.

The speaker unit 34*a* is of the bass-reflex type. A port 50*a* for bass reflex is defined in any of other outer surfaces of the cabinet 40*a* than the top face 41*a*. In this case, the port 50*a* is defined in one of the side faces 43*a* of the cabinet 40*a*. An acoustic tube or duct is defined in the cabinet 40*a* by partition walls 52*a*. The duct defines a passage 54*a* that communicates with the port 50*a*. A sound that is emitted from the back of the speaker 46*a* into the cabinet 40*a* partially passes through the passage 54*a* and is radiated from the port 50*a* in phase with a sound that is emitted from the front of the speaker.

Figure 7:
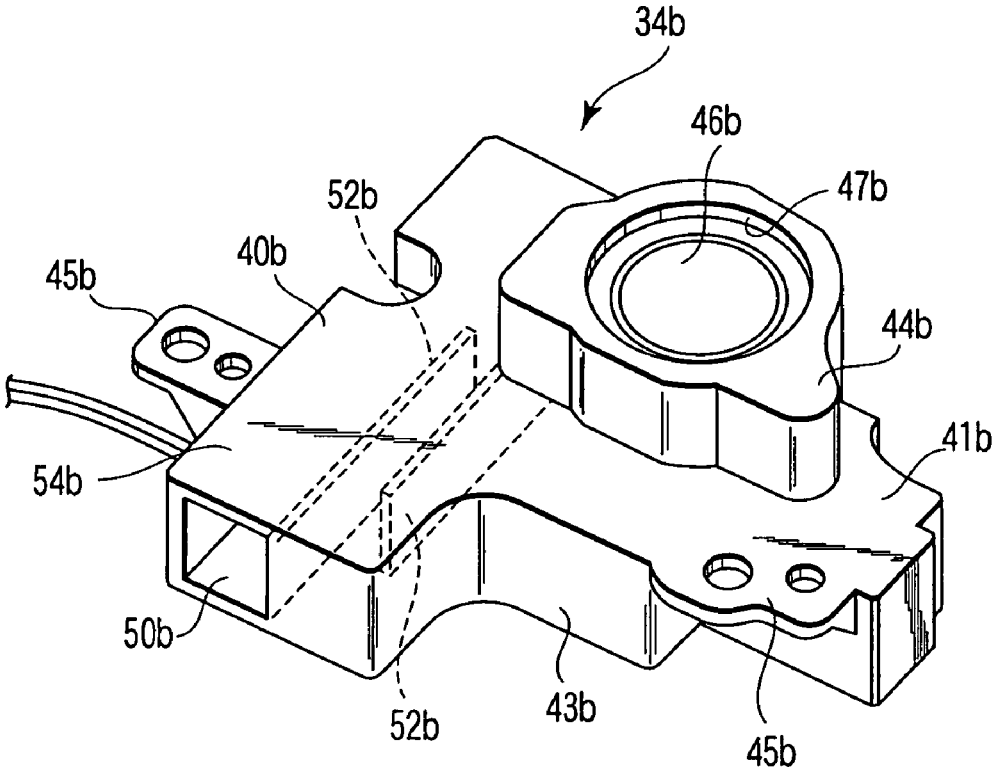
FIG. 7 is a perspective view showing the other speaker unit.
Figure 8:
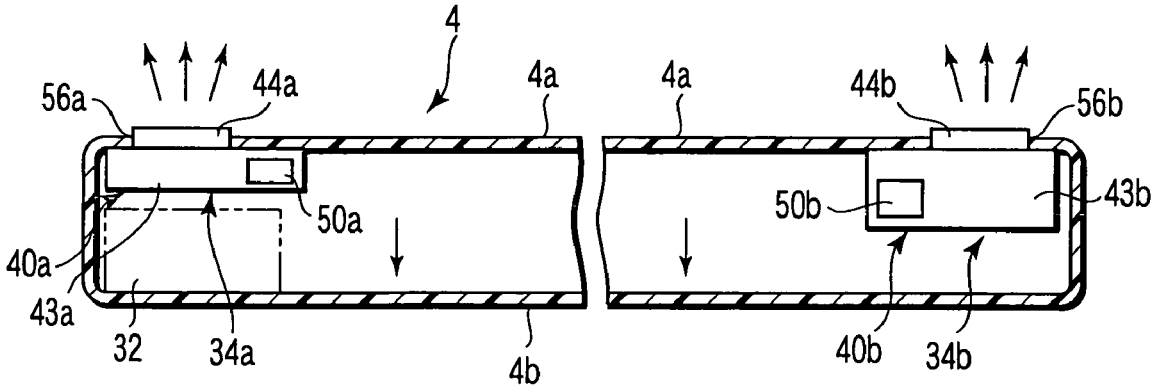
FIG. 8 is a sectional view showing the rear end portion of the computer body.
Figure 9:
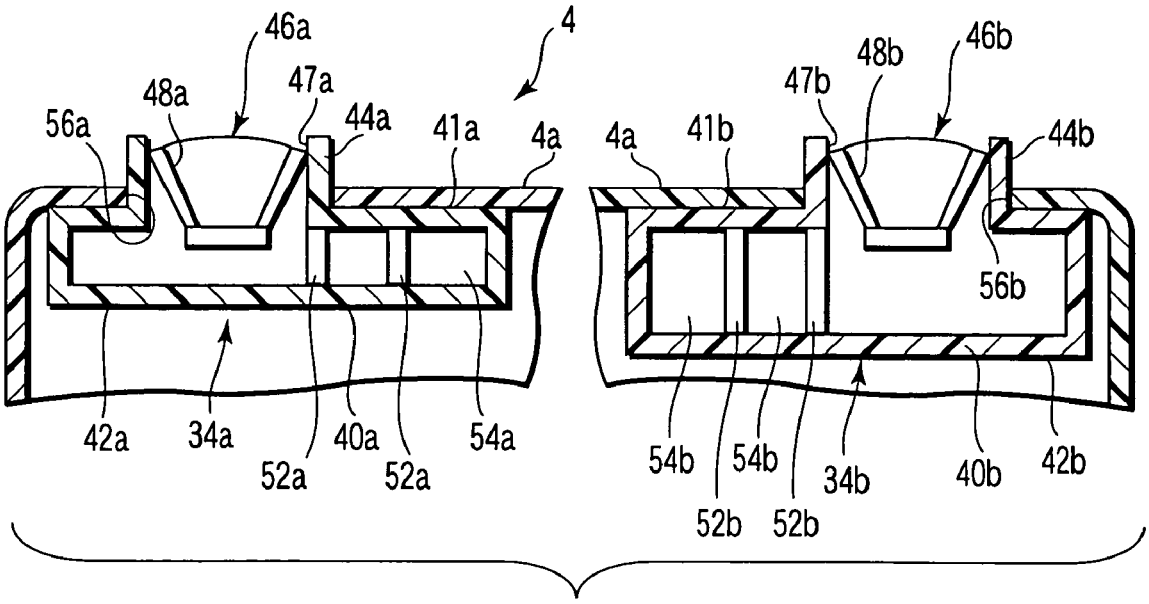
FIG. 9 is a sectional view showing the rear end portion of the computer body and the speaker units.

As shown in FIGS. 7 to 9, the other speaker unit 34*b* is constructed in the same manner as the speaker unit 34*a*. Like reference numerals with different subscripts a and b are used to designate like components of the speaker units 34*a* and 34*b*, respectively, and a detailed description of those components will not be repeated. A cabinet 40*b* of the speaker unit 34*b* is larger in capacity than the cabinet 40*a* of the speaker unit 34*a*.

The speaker units 34*a* and 34*b* constructed in this manner are located in the rear end portion of the casing 4 and fixedly screwed to the inner surface of the top wall 4*a* of the casing 4. As shown in FIGS. 4, 5, 8 and 9, openings 56*a* and 56*b* are defined individually in the two corner portions of the top wall 4*a* of the casing 4 on its rear end side. The speakers of the speaker units 34*a* and 34*b* are exposed through the openings 56*a* and 56*b*. The openings 56*a* and 56*b* are shaped corresponding to the respective cross sections of protrusions 44*a* and 44*b* on the cabinets 40*a* and 40*b* of the speaker units 34*a* and 34*b*. The speaker units 34*a* and 34*b* are screwed to the top wall 4*a* with the protrusions 44*a* and 44*b* of the cabinets 40*a* and 40*b* passed through the openings 56*a* and 56*b*, respectively, and with the top faces 41*a* and 41*b* of the cabinets intimately in contact with the inner surface of the top wall 4*a* of the casing 4.

Thus, the respective speakers 46*a* and 46*b* of the speaker units 34*a* and 34*b* are exposed outward from the casing 4 through the openings 56*a* and 56*b* of the casing. Further, ports 50*a* and 50*b* in the cabinets 40*a* and 40*b* open into the casing 4. The ports 50*a* and 50*b* open in the same direction. In the present embodiment, they open toward the front end portion of the casing 4.

Partition walls 60*a* and 60*b* are set up integrally on the top wall 4*a* of the casing 4 so as to surround the openings 56*a* and 56*b*, respectively. Further, the top wall 4*a* is fitted with protective nets 62*a* and 62*b*, which cover the partition walls 60*a* and 60*b* and the openings 56*a* and 56*b*, respectively.

When the speaker units 34*a* and 34*b* are worked, as shown in FIGS. 2 and 8, high-, medium-, and low-pitched sounds that are emitted from the front side of the speakers 46*a* and 46*b* radiated directly outward from the casing 4. On the other hand, low-pitched sounds that are emitted from the backside of the speakers 46*a* and 46*b* into the cabinets 40*a* and 40*b* are radiated from the ports 50*a* and 50*b* into the casing 4 in phase with the sounds emitted from the front of the speakers. Since low-pitched sounds are low in directivity, the low-pitched sounds that are emitted from the speaker units 34*a* and 34*b* into the casing 4 are synthesized together. The resultant sound vibrates the whole casing 4 and is partially radiated to the outside of the casing through the air inlets 36 in the bottom wall 4*b* of the casing and various gaps. Thus, the bass range can be enhanced to reproduce rich low-pitched sounds or voices.

According to the portable computer constructed in this manner, the bass-reflex speaker units 34*a* and 34*b* are located in the casing 4 of the computer body 2, and their speakers 46*a* and 46*b* are exposed outward from the casing through the openings 56*a* and 56*b*. The bass-reflex ports 50*a* and 50*b* in the cabinets 40*a* and 40*b* open into the casing 4 without being exposed in the outer surface of the casing. In designing the speaker units 34*a* and 34*b*, therefore, the ports 50*a* and 50*b* and the ducts that extend from them can be arranged freely, so that the degree of freedom of design can be heightened considerably. Further, the outer surface of the casing 4 need not be formed partially of those parts of the cabinets 40*a* and 40*b* in which the ports 50*a* and 50*b* are defined, so that restrictions on the shape and the like in the design of the cabinets can be reduced. Thus, cabinets that are adapted for portable computers can be developed easily in a short period of time.

In the embodiment described above, the speaker unit 34*a* is located overlapping the cooling unit 32, so that its cabinet 40*a* is made smaller than the cabinet 40*b* of the other speaker unit 34*b*. Thus, the cabinets 40*a* and 40*b* are different in capacity. As mentioned before, however, the ports 50*a* and 50*b* of the cabinets 40*a* and 40*b* open into the casing 4, and the low-pitched sounds are radiated from these ports into the casing. The radiated low-pitched sounds are low in directivity, and a user can hear the resultant sound created in the casing 4 substantially from the central portion of the casing 4. If the respective cabinets 40*a* and 40*b* of the opposite speaker units 34*a* and 34*b* are different in capacity, therefore, a feeling of imbalance between the low-pitched sounds can be lessened. Accordingly, the cabinets 40*a* and 40*b* of the speaker units 34*a* and 34*b* can be designed having different sizes and capacities, depending on the conditions of layout in the casing 4 and the like. In consequence, the degree of freedom of the design of the speaker units can be heightened further.

Thus, there may be obtained a portable computer of which the design of the speaker units enjoys a high degree of freedom and which can reproduce sounds of high tone quality.

Figure 10:
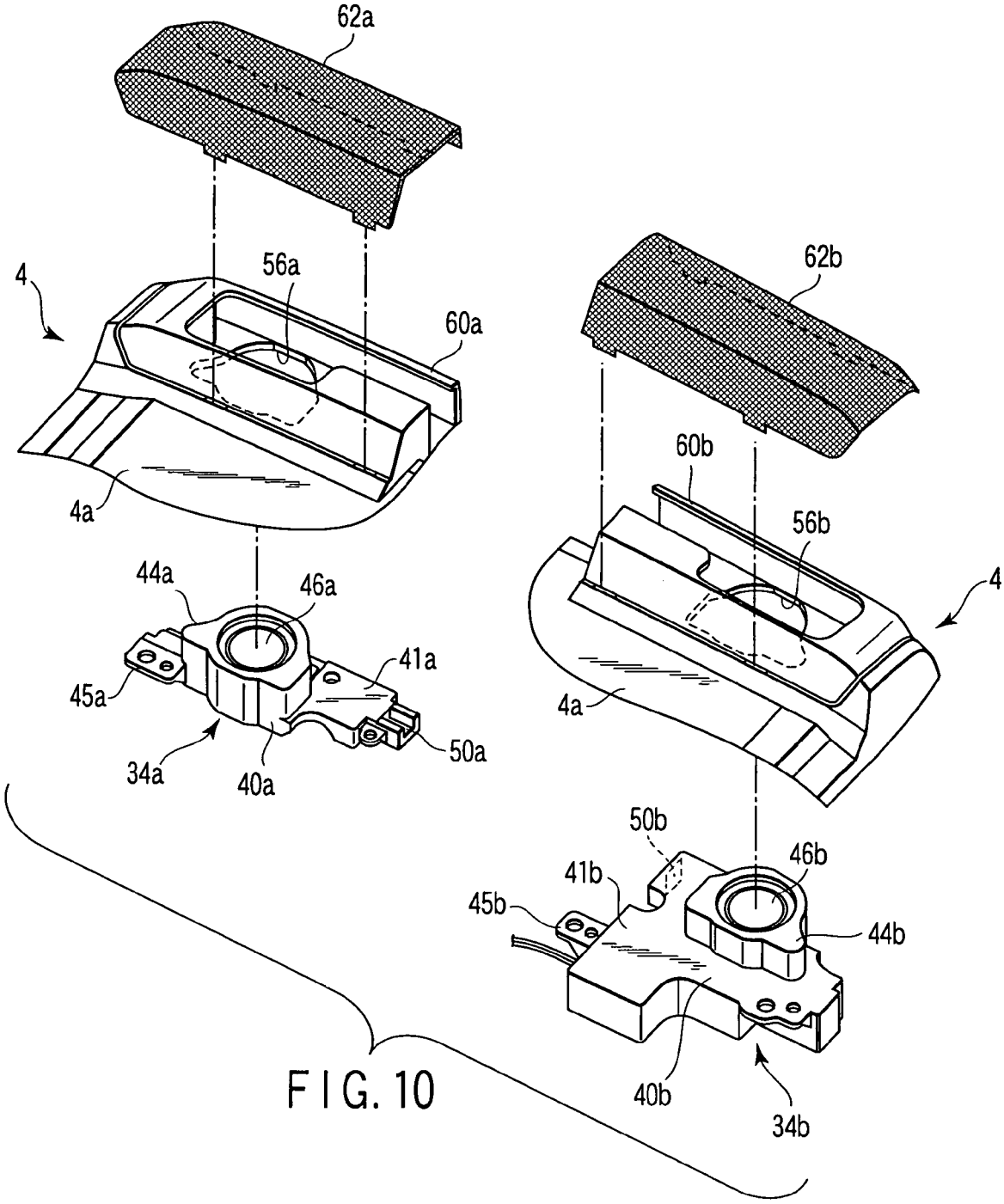
FIG. 10 is an exploded perspective view showing the rear end portion of the body of a portable computer according to a second embodiment and speaker units.
Figure 11:
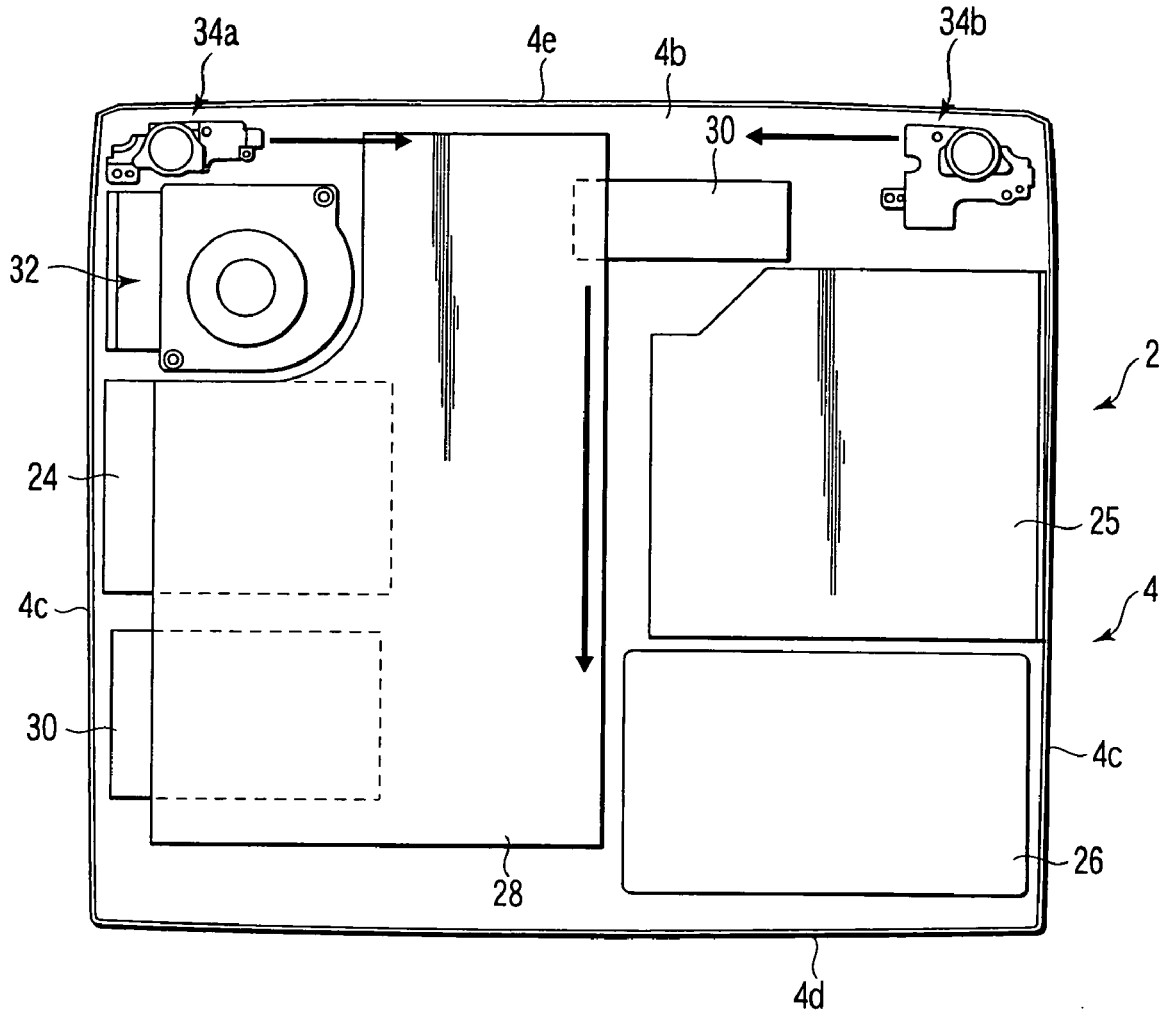
FIG. 11 is a plan view showing the interior of the body of the portable computer according to the second embodiment.

In the embodiment described above, the ports in the respective cabinets of the speaker units open forward into the casing 4. However, these ports are expected only to open into the casing, and their direction can be changed variously. According to a second embodiment shown in FIGS. 10 and 11, for example, ports 50*a* and 50*b* of speaker units 34*a* and 34*b* that are arranged left and right open opposite to each other, that is, inward in the width direction of the casing 4. The second embodiment shares other configurations with the foregoing embodiment. Therefore, like reference numerals are used to designate like portions of these embodiments, and a detailed description of those portions is omitted.

Also with this arrangement, low-pitched sounds that are radiated from the ports 50*a* and 50*b* of the cabinets 40*a* and 40*b* into the casing 4 can be synthesized in the casing and heard substantially from the central portion of the casing by the user. Thus, the same functions and effects of the foregoing first embodiment can be obtained.

Further, the present invention is not limited to portable computers, and may be also applied to some other electronic apparatuses, such as a PDA (personal digital assistant). Furthermore, the number of speaker units is not limited to two, and may be one or three or more. Although the speakers of the speaker units are exposed in the top wall of the casing according to the foregoing embodiments, moreover, they may alternatively be exposed in any other outer surfaces, such as the sidewalls, bottom wall, etc.

What is claimed is:

1. An electronic apparatus comprising:

a casing defining a closed space, the closed space containing electronic components and a pair of speaker units; and each of the speaker units including a cabinet arranged in the closed space of the casing, a speaker arranged in the cabinet and exposed to the outside of the cabinet, a port which is defined in the cabinet to directly open to the closed space of the casing and through which a sound emitted from the backside of the speaker into the cabinet is radiated outward from the cabinet and into the entire closed space of the casing, and a duct which is arranged in the cabinet and defines a tortuous passage that communicates the rear of the speaker with the port, the cabinet of each speaker unit having a top face in contact with an inner surface of an outside wall of the casing and a protrusion which protrudes from the top face and passes through an opening defined in the outside wall of the casing, the speaker being located in the cabinet so as to be exposed to the outside of the casing through the opening of the casing and the protrusion, and the casing having openings through which sounds emitted from the ports of the cabinets into the closed space of the casing and synthesized together in the closed space of the casing are radiated to the outside of the casing.

2. electronic apparatus according to claim 1, wherein the respective cabinets of the speaker units have different capacities.

3. An electronic apparatus according to claim 1, wherein the speaker units are arranged in the casing with the respective ports thereof opposed to each other.

4. An electronic apparatus according to claim 1, wherein the speaker units are arranged in the casing with the respective ports thereof oriented in the same direction.

5. An electronic apparatus according to claim 1, which further comprises a display unit having a display panel and connected to the casing, and a keyboard attached to the casing.

6. An electronic apparatus according to claim 1, wherein each of the speaker units further includes a duct which is arranged in the cabinet and defines a tortuous passage that communicates the rear of the speaker with the port.

7. An electronic apparatus according to claim 1, wherein the speaker units are mounted inside the casing with at least one removable fastener.

8. An electronic apparatus according. to claim 7, wherein at least one removable fastener is a screw.

9. An electronic apparatus according to claim 1, wherein the casing includes partition walls extending from a top surface of the casing which surround the openings, respectively.

10. An electronic apparatus according to claim 9, further comprising protective nets that cover the partition wall and the openings.

11. An electronic apparatus comprising:

a casing defining a closed space, the closed space containing electronic components and a pair of sneaker units; and each of the speaker units including a cabinet arranged in the closed space of the casing, a speaker arranged in the cabinet and exposed to the outside of the cabinet, a port which is defined in the cabinet to directly open to the closed space of the casing and through which a sound emitted from the backside of the speaker into the cabinet is radiated outward from the cabinet and into the entire closed space of the casing, and a duct which is arranged in the cabinet and defines a tortuous passage that communicates the rear of the speaker with the port, the speaker being exposed to the outside of the casing through an opening defined in an outside wall of the casing, and the casing having openings through which sounds emitted from the ports of the cabinets into the closed space of the casing and synthesized together in the closed space of the casing are radiated to the outside of the casing, the casing being a laptop computer, and the speaker units being positioned at left and right corners of a top wall of the laptop computer, respectively, and the speakers being oriented towards the top wall of the laptop computer and the ports being oriented toward a front wall of the laptop computer.

12. An electronic apparatus comprising:

a casing defining a closed space, the closed space containing electronic components and a pair of sneaker units; and each of the speaker units including a cabinet arranged in the closed space of the casing, a speaker arranged in the cabinet and exposed to the outside of the cabinet, a port which is defined in the cabinet to directly open to the closed space of the casing and through which a sound emitted from the backside of the speaker into the cabinet is radiated outward from the cabinet and into the entire closed space of the casing, and a duct which is arranged in the cabinet and defines a tortuous passage that communicates the rear of the speaker with the port, the speaker being exposed to the outside of the casing through an opening defined in an outside wall of the casing, and the casing having openings through which sounds emitted from the ports of the cabinets into the closed space of the casing and synthesized together in the closed space of the casing are radiated to the outside of the casing, the casing being a laptop computer, and the speaker units being positioned at left and right corners of a top wall of the laptop computer, respectively, and the speakers being oriented towards the top wall of the laptop computer and the ports being oriented toward opposite sidewalls of the laptop computer, such that the respective ports are opposed to each other.

* * * * *